US007854029B2

(12) United States Patent
Shih

(10) Patent No.: US 7,854,029 B2
(45) Date of Patent: Dec. 21, 2010

(54) WATER DRAIN ASSEMBLY

(76) Inventor: Ti-Nien Shih, 5F, No. 1, Alley 40, Lane 71, Jiang Nan Street, Neihu District, Taipei City (TW)

( * ) Notice: Subject to any disclaimer, the term of this patent is extended or adjusted under 35 U.S.C. 154(b) by 739 days.

(21) Appl. No.: 11/843,067

(22) Filed: Aug. 22, 2007

(65) Prior Publication Data

US 2009/0049601 A1 Feb. 26, 2009

(51) Int. Cl.
*A47K 1/14* (2006.01)
*E03C 1/26* (2006.01)

(52) U.S. Cl. ..... 4/286; 4/292; 4/290; 4/288; 4/652

(58) Field of Classification Search ..... 4/286–292, 4/652

See application file for complete search history.

(56) References Cited

U.S. PATENT DOCUMENTS 1,849,604 A * 3/1932 Weatherhead, Jr. ..... 411/352
1,890,348 A * 12/1932 Weatherhead, Jr. ..... 411/352
3,700,381 A * 10/1972 Deeke ..... 4/288
4,883,590 A * 11/1989 Papp ..... 4/288
2010/0005581 A1 * 1/2010 McAlpine ..... 4/291

* cited by examiner

*Primary Examiner*—Khoa D Huynh
(74) *Attorney, Agent, or Firm*—Rabin & Berdo, P.C.

(57) ABSTRACT

A water drain assembly includes an embedding ring and a seal washer, such that when a force is applied to press onto a water drain body, the deformation of hooks disposed at a lower edge of the embedding ring latches the edge of a drain through hole to abut the water drain body and fix the water drain body in position, and a rubber seal ring and a pressing member are installed into an internal hole of the water drain body, and a jam-on member is pressed into the internal hole of the water drain body, so as to press the pressing member down to a predetermined position to deform the seal ring, and achieve a tight pressing relation with a drainage pipe inserted therein to achieve a seal waterproof relation between the drainage pipe and the water drain body, and complete the overall installation of the water drain.

2 Claims, 8 Drawing Sheets

WATER DRAIN ASSEMBLY

BACKGROUND OF THE INVENTION

1. Field of the Invention

The present invention relates to a water drain assembly, and more particularly to an innovative structure of a water drain assembly designed specifically for maintenance-ready type sanitary equipments, and the water drain can be installed quickly and easily without requiring a hand tool, so as to solve the problems and overcome the shortcomings of the traditional water drains that adopt screws for installation.

2. Description of the Related Art

Referring to FIG. 1 for the installation of a water drain with a strainer through hole and a drainage pipe of a general maintenance-ready type sanitary equipment, the water drain includes a water drain body 10, an external screw thread 101 disposed on an external periphery of the water drain body 10 and corresponding to a seal washer 11, a ring pad 12, and a locking ring 13 screwed onto the external screw thread 101 of the water drain body 10 by a hand tool such as a wrench, so that the water drain body 10 is installed to a drain through hole which is disposed at a predetermined position on the floor, and a bottom rim of the internal hole of the water drain body 10 forms a tapered stop edge 102, so that a rubber seal ring 14 can be installed in the water drain body 10 for achieving an appropriate limit position, and a plurality of concave costal grooves 141 can be made on an internal rim of the seal ring 14 for achieving a tighter pressing relation with a drainage pipe 16 therein, and an internal screw thread 103 can be made at an upper section of an internal hole of the water drain body 10 and secured with a positioning ring 15 having an external screw thread 151, for fastening a lower section of the seal ring 14 to deform the seal ring 14 and constitute a tight fastening relation with the drainage pipe 16, so as to achieve the water seal anti-leakage effect between the water drain body 10 and the drainage pipe 16. To facilitate securing the positioning ring 15, the invention includes several pairs of slots (not shown in the figure) disposed at a top edge of the positioning ring 15 for embedding a tool board (not shown in the figure) and a insert slot disposed at the middle of the tool board for inserting tools such as screwdrivers and facilitating the operation of securing the positioning ring 15. After a seal waterproof relation between the drainage pipe 16 and the water drain body 10 is achieved by fastening the positioning ring 15 to the seal ring 14, the tool board can be removed. Finally, a strainer 17 with the drain holes 171 is disposed at the top of the water drain body 10 to complete the overall installation. However, the assembly of the foregoing conventional water drain still has the following drawbacks:

1. The installation is complicated and time-consuming. Since both installation of the water drain body onto the floor and the fastening of the positioning ring to the seal ring are achieved by securing screws and requiring a hand tool of a specific tool for the installation. Such arrangement not only makes the installation relatively inconvenient, but also consumes much time, and thus the conventional water drain assembly cannot be considered simple and easy.

2. Since the water drain body is secured onto the floor by locking an external screw thread of the locking ring from the bottom of the floor, a clamping and locking effect is achieved. Although a pre-assembly can be performed before the installation of a new product of maintenance-ready type sanitary equipment or a construction, the entire maintenance-ready type sanitary equipment must be removed completely for replacement or maintenance, if the water drain is damaged and leaked after the water drain has been used for a while. Such construction is effort and time consuming.

3. Since the external circumference of the water drain body has the screw threads, material and manufacturing costs cannot be lowered, and the overall manufacturing cost is affected seriously, which is not competitive in the market.

In other words, the structure and design of the conventional water drain assembly are not good enough, and thus its production cost is too high, and its installation is too complicated and time-consuming. In the meantime, the conventional water drain assembly cannot meet the requirements of repairs and maintenance, and the prior art obviously requires further improvements.

SUMMARY OF THE INVENTION

In view of the foregoing shortcomings of the prior art, the inventor of the present invention based on years of experience in the related industry to conduct extensive researches and experience, and finally developed a water drain assembly in accordance with the present invention.

The primary objective of the present invention is to overcome the shortcomings of the prior art by providing a water drain assembly, such that a water drain body can be installed and connected to a drain through hole and a drainage pipe of the water drain assembly without requiring any hand tool, but the installation simply requires a pressing action to complete installing the assembly in a simple, easy and quick manner.

A secondary objective of the present invention is to provide a simple and convenient assembling procedure for a water maintenance-ready type sanitary equipment, such that it is not necessary to remove the entire maintenance-ready type sanitary equipment for maintaining or replacing a water drain. Thus, the invention further eliminates the possibility of damaging the water drain during its replacement, and thoroughly overcome the drawback of the conventional water drain that cannot be replaced easily.

Another preferred embodiment of the present invention is to provide an easy assembly of a water drain with a simplified structure, such that its installation can be achieved without using complicated screw connections. The assembly can be manufactured directly by pipes only, and thus the manufacturing cost can be lowered significantly, and the market competitiveness can be enhanced.

DETAILED DESCRIPTION OF THE PREFERRED EMBODIMENTS

To make it easier for our examiner to understand the objectives, characteristics and effects of the present invention, a preferred embodiment with accompanying drawings are used for a detailed description of the invention as follows.

Figure 1:
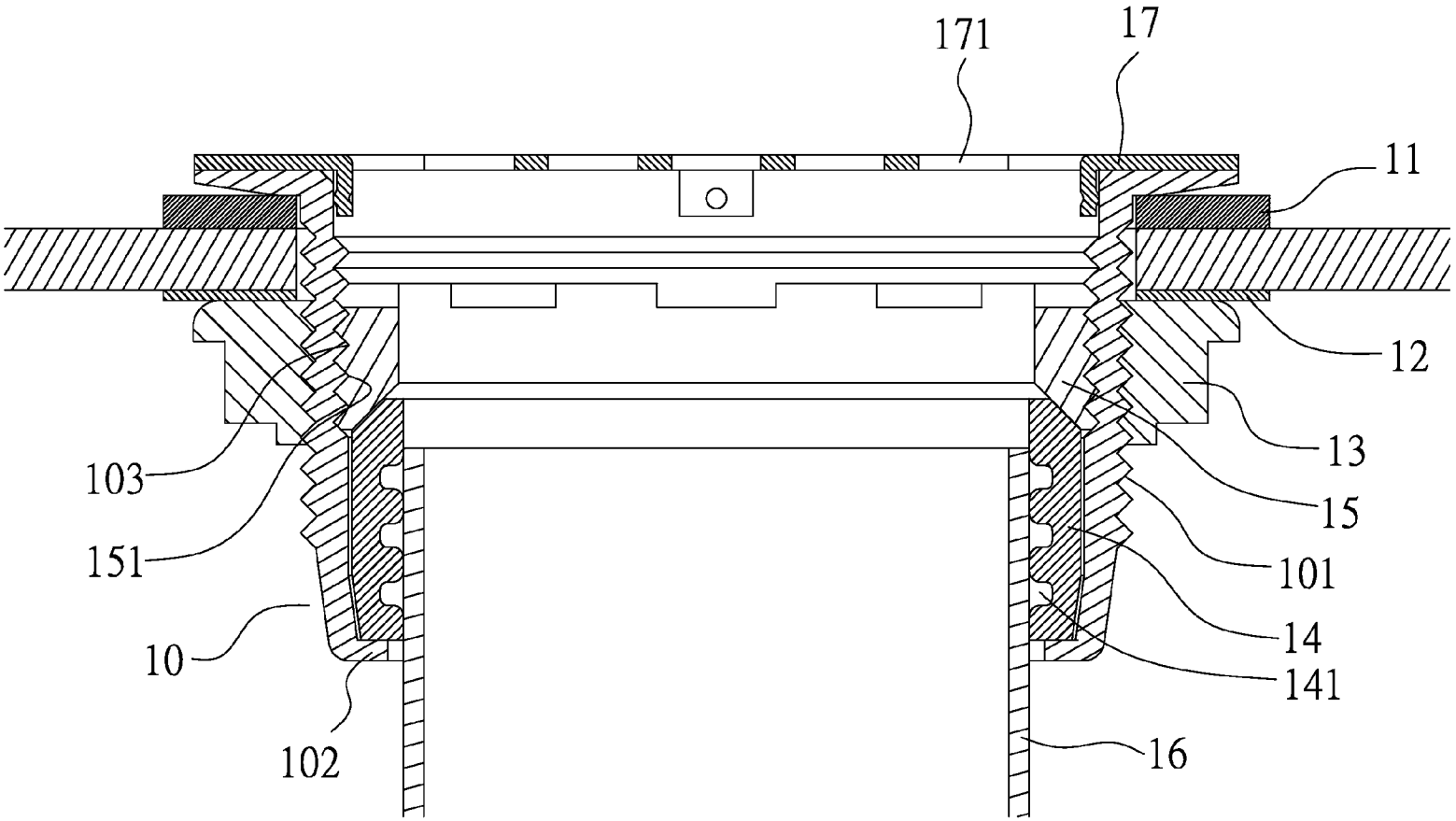
Fig. 1 Prior Art
FIG. 1 is a schematic view of a structural relation of a prior art water drain.
Figure 2:
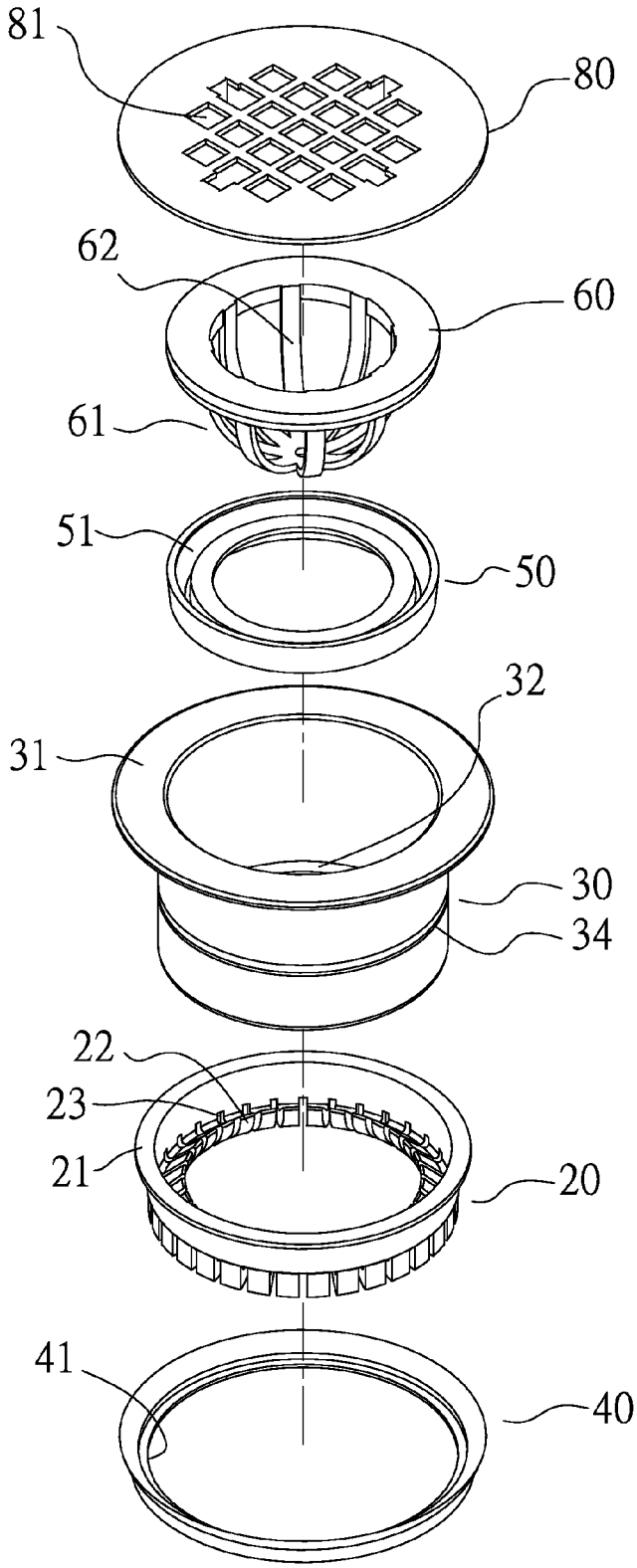
FIG. 2 is an exploded view of a water drain assembly in accordance with a preferred embodiment of the present invention.
Figure 3:
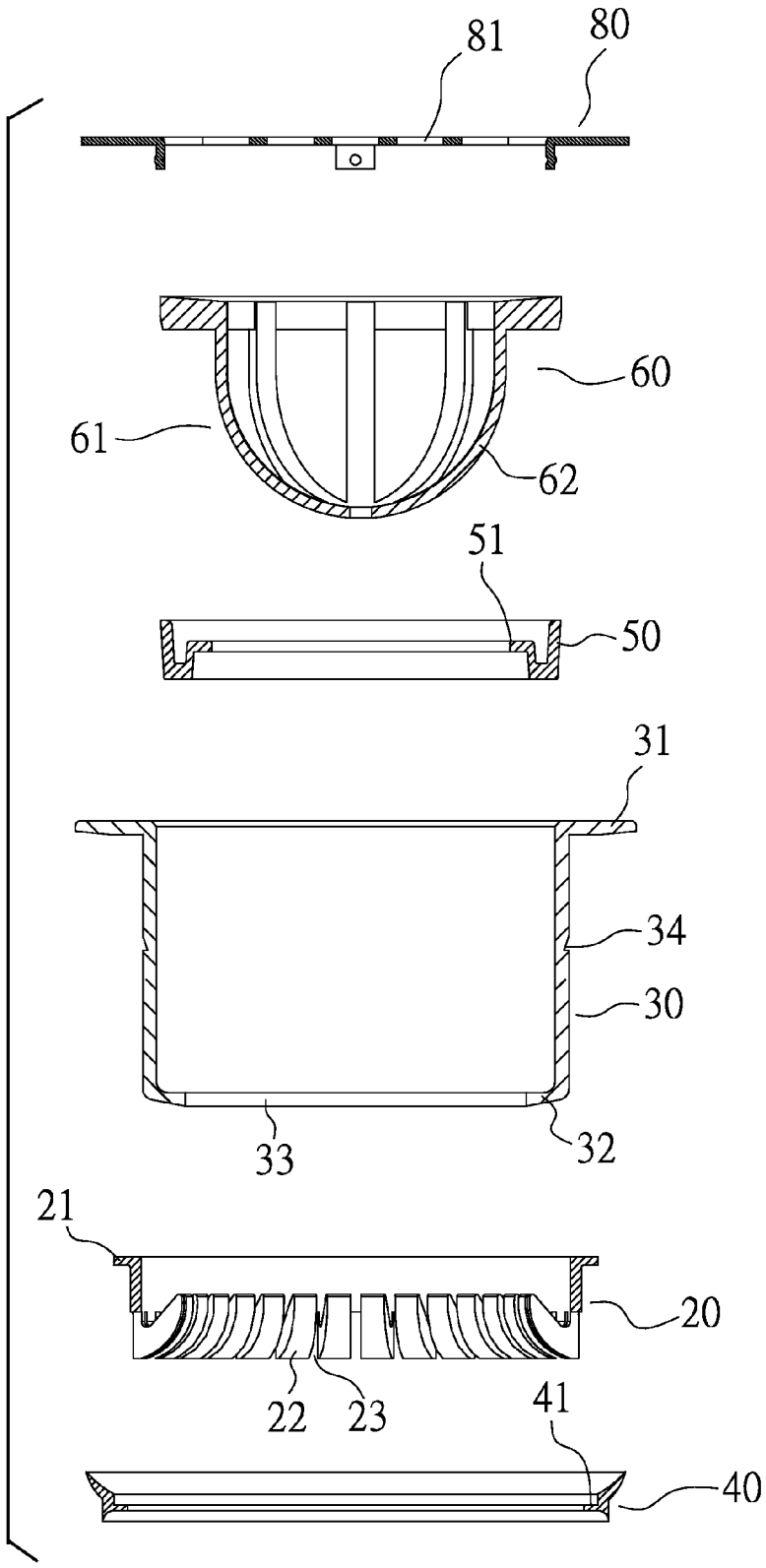
FIG. 3 is a schematic planar view of a water drain assembly in accordance with a preferred embodiment of the present invention.
Figure 4:
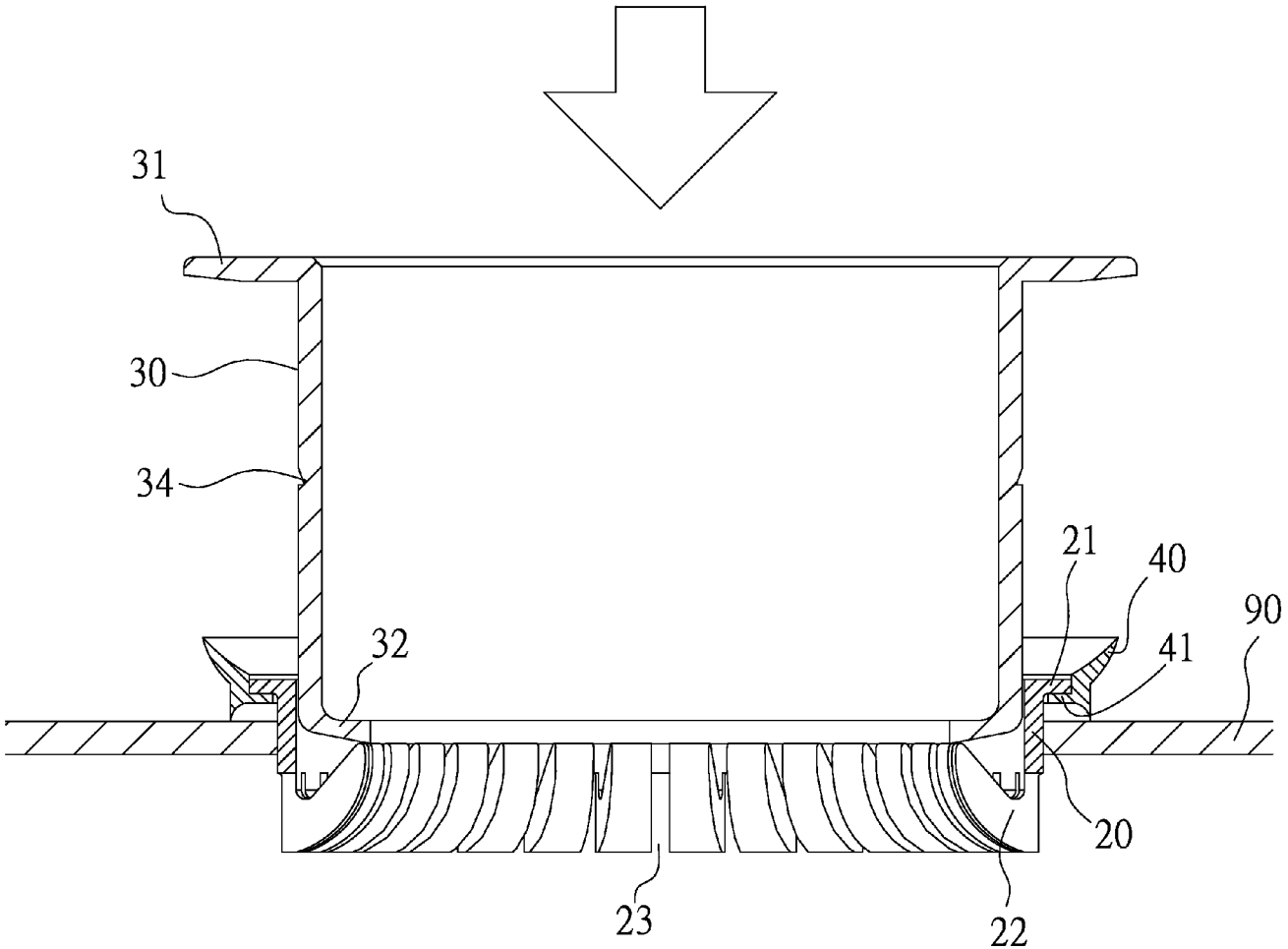
FIG. 4 is a schematic view of installing a water drain body in accordance with a preferred embodiment of the present invention.
Figures 5, 5A:
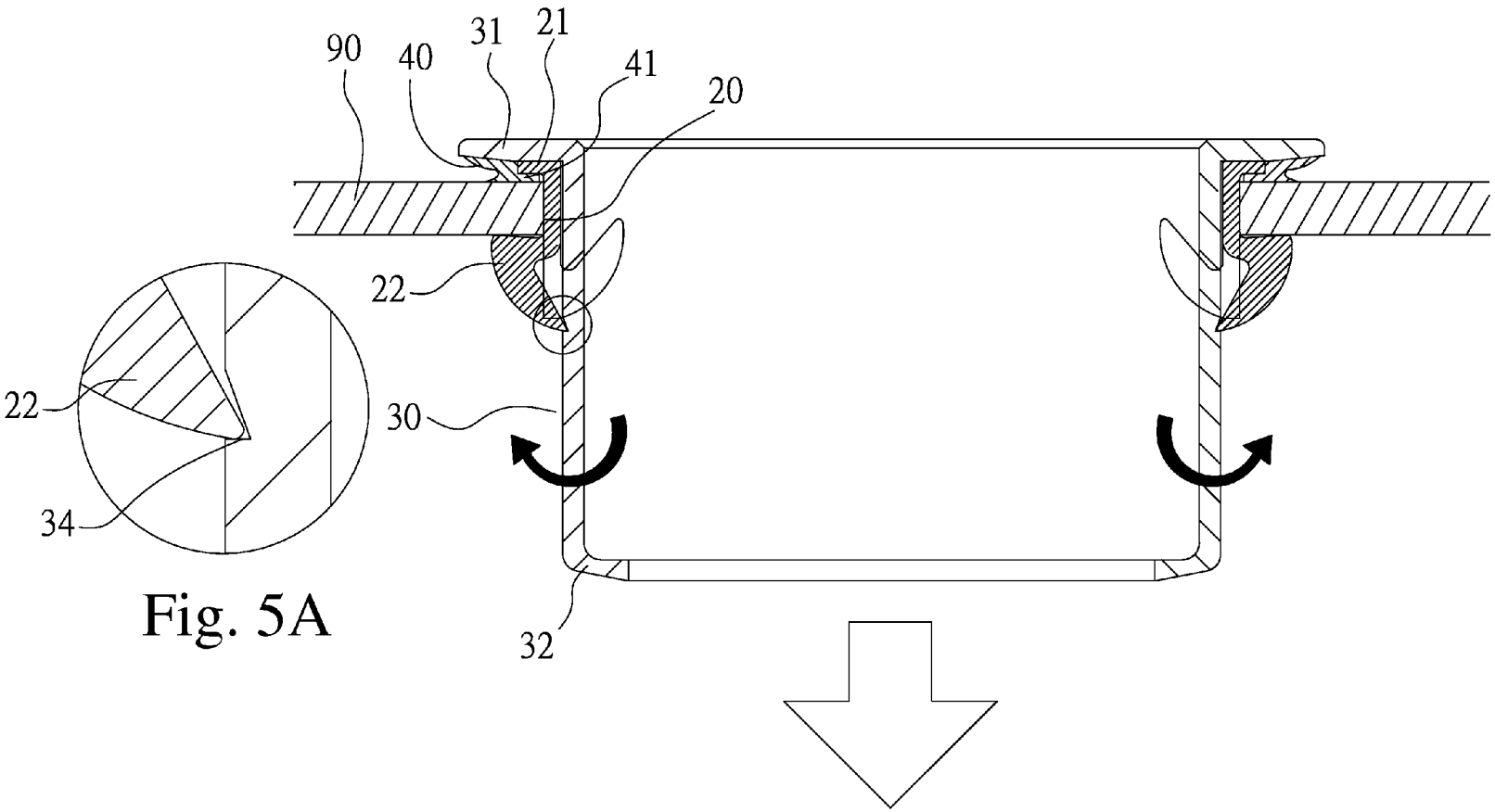
FIG. 5 is a schematic view of an installed water drain body in accordance with a preferred embodiment of the present invention.
FIG. 5A is A partial structure enlarged drawing of FIG. 5.
Figure 6:
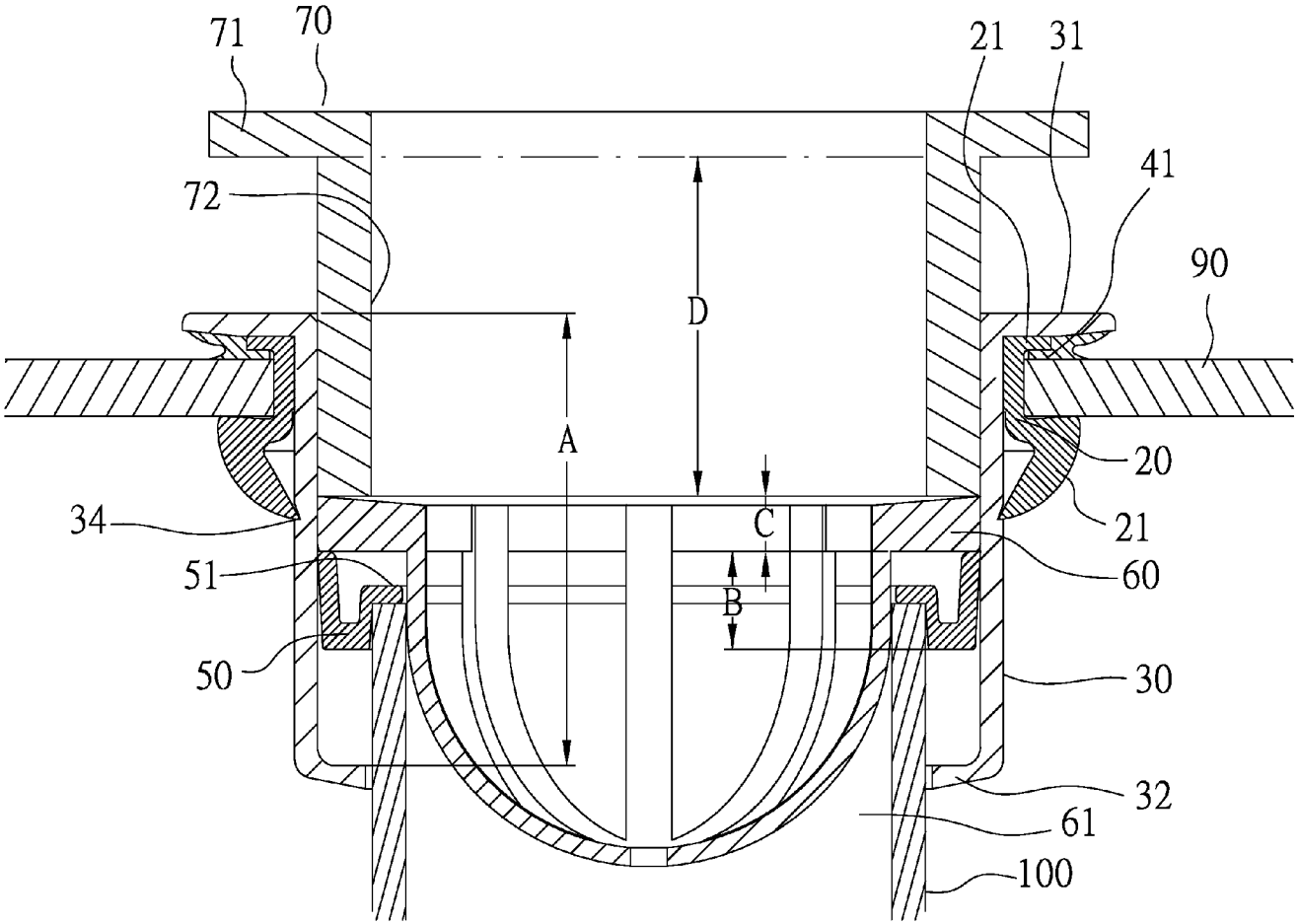
FIG. 6 is a schematic view of installing a seal ring and a pressing member in accordance with a preferred embodiment of the present invention.
Figure 7:
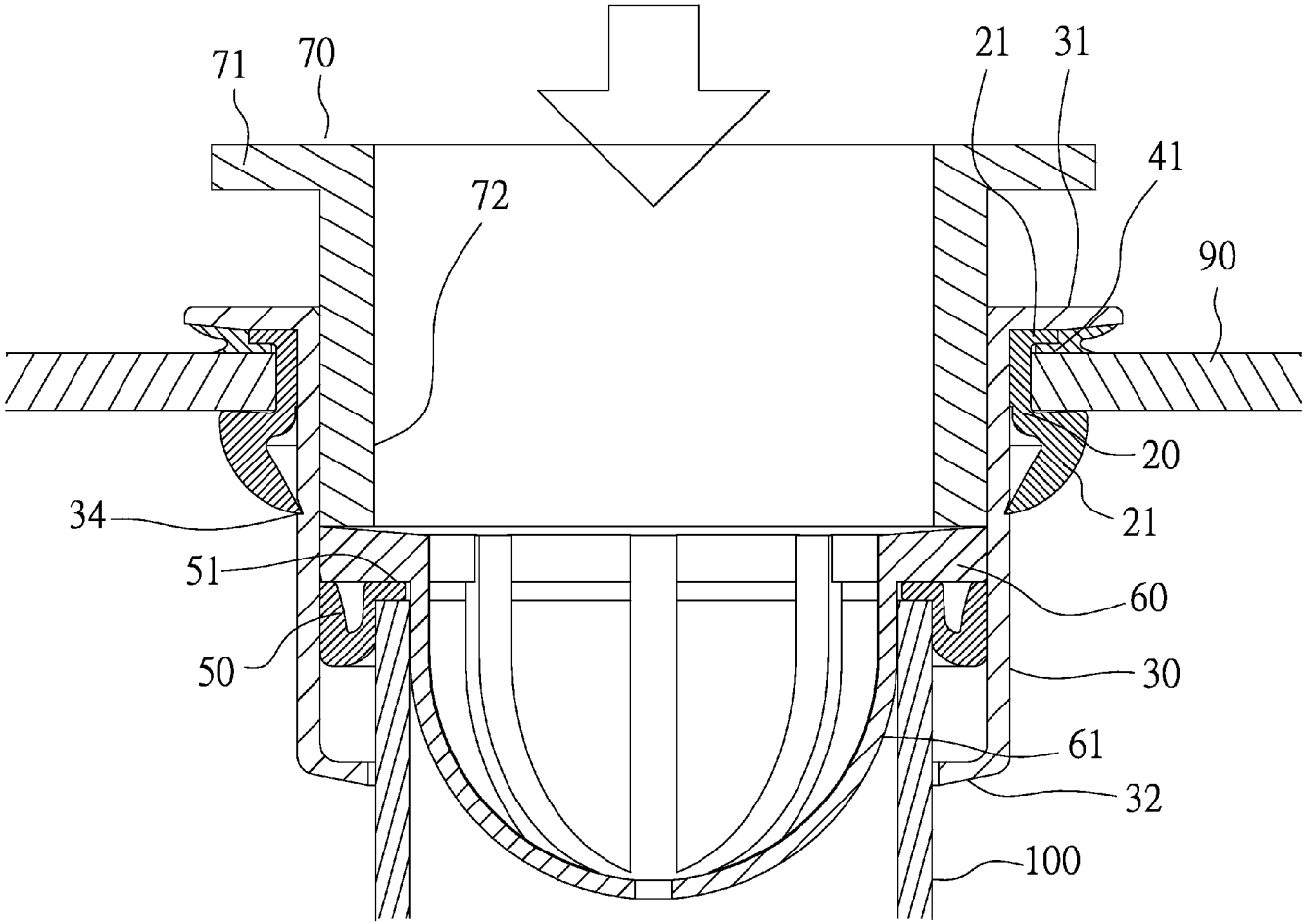
FIG. 7 is a schematic view of installed seal ring and pressing member in accordance with a preferred embodiment of the present invention.
Figure 8:
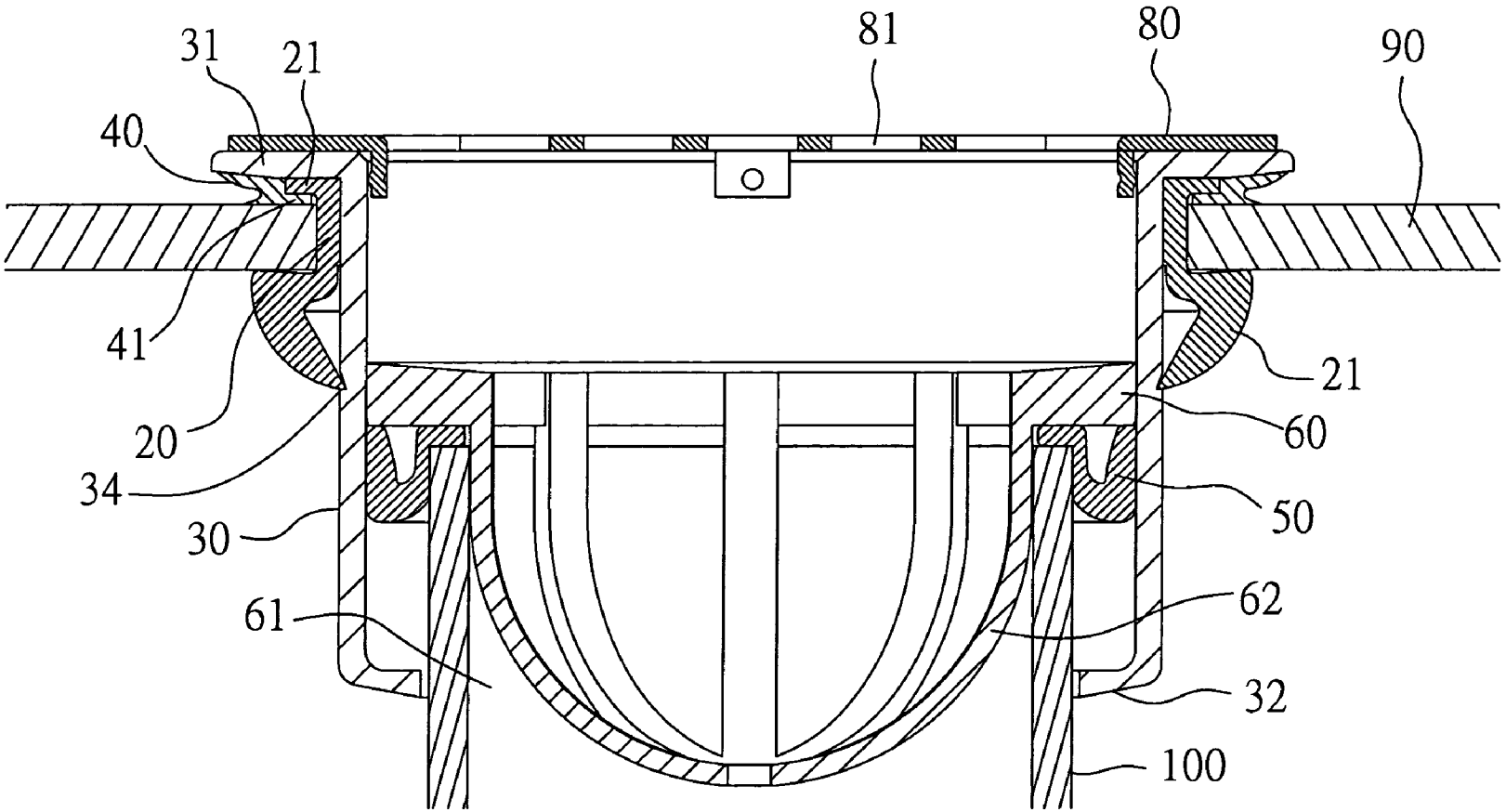
FIG. 8 is a schematic view of a structural relation of an overall installed water drain assembly in accordance with a preferred embodiment of the present invention.

Referring to FIG. 2 for an exploded view, FIG. 3 for a schematic planar view, FIGS. 4 to 7 for schematic view of installing a water drain assembly, and FIG. 8 for a structural relation of a water drain assembly in accordance with a preferred embodiment of the present invention, the water drain assembly is applied to a maintenance-ready type sanitary equipment in this preferred embodiment. The water drain assembly of the invention comprises:

an embedding ring 20, made of a low-priced plastic, and having an external circumference matched with a drain through hole made on a floor 90 where the maintenance-ready type sanitary equipment is installed, and a top slightly larger than a blocking ring edge 21, such that when the embedding ring 20 is installed into the drain through hole for limiting the position, a predetermined quantity of hooks 22 disposed at the bottom of the embedding ring 20 and aligned inwardly and having a gap 23 between two adjacent hooks 22, and tapered from top to bottom of the gap 23 from the external circumference of the embedding ring 20, such that the structural strength at the positions of the hooks 22 is weaker for providing a better deformation rate;

a water drain body 30, with its external circumference matched with an internal circumference of the embedding ring 20, and having a ring plate 31 disposed on the top of the water drain body 30 and with an area large enough to cover a blocking ring edge 21 of the embedding ring 20, and a circular slanting push portion 32 disposed at the bottom of the water drain body 30 and aligned inwardly and slantingly from the bottom, such that a through hole 33 formed by the circular slanting push portion 32 is slightly larger than an external circumference of the drainage pipe 100, and having a ring embedding groove 34 disposed at a predetermined position on the external circumference of the water drain body 30, wherein the ring embedding groove 34 is designed slantingly at the top and horizontally at the bottom for achieving an installing and positioning relation of a hook portion after the hooks of the embedding ring 20 are deformed;

a seal washer 40, made of a rubber material, and having a ring embedding edge 41 disposed around the internal circumference, such that the embedding ring 20 is sheathed into the seal washer 40, and the blocking ring edge 21 at the top of the embedding ring 20 is limited to the ring embedding edge 41 of the seal washer 40, and the seal washer 40 is used as a water seal interface between the embedding ring 20, the water drain body 30 and the floor 90, and when the water drain body 30 is installed to the floor 90, the expected seal anti-leakage effect can be achieved;

a seal ring 50, made of a rubber material, with its external circumference matched with an internal circumference of the water drain body 30, and having a blocking ring 51 disposed on an internal circumference of the seal ring 50, such that the cross-section and diameter of the blocking ring 51 and the drainage pipe 100 are equal, for facilitating the seal ring 50 can be installed easily at the top of the drainage pipe 100;

a pressing member 60, with its external circumference closely corresponding to an internal circumference of the water drain body 30, and having a guiding net 61 extended from its lower edge and formed by intersecting a plurality of strip plates 62 by the pressing member 60, such that the pressing member 60 has an appropriate straight and flat section and its lower section forms a curved shape, and the straight and flat section of the guiding net 61 comes with a depth greater than the thickness of the seal ring 50, and the external circumference of straight and flat section of the guiding net 61 is slightly smaller than the internal circumference of the drainage pipe 100, so that the guiding net 61 concurrently has the function of guiding the drainage pipe 100 properly and filtering hairs;

a jam-on member 70, having a stop ring 71 disposed at its top and with a dimension slightly greater than the internal hole of the water drain body 30, so as to prevent the jam-on member 70 from being sheathed into the internal hole of the water drain body 30, and the external diameter of its pipe pressing portion 72 is slightly smaller than the internal hole of the water drain body 30, and the length D of the pipe pressing portion 72 is greater than the depth A of the internal hole of the water drain body 30 minus the thickness B of the seal ring 50 thickness plus the thickness C of the pressing member 60 (or $D>A-B+C$); and a strainer 80, embedded and covered onto the top of the water drain body 30, and having a plurality of drain holes 81 disposed thereon.

In the design of the assembly composed of the aforementioned components, an embedding ring 20 is embedded and sheathed into the seal washer 40 first, and the embedding ring 20 is sheathed into the drain through hole of the floor 90 to install the water drain body 30 to the floor 90, and the water drain body 30 is sheathed into an internal hole of the embedding ring 20 and pressed downward until the ring plate 31 of the water drain body 30 is blocked to press the seal washer 40. During the process of moving the water drain body 30 downward, the circular slanting push portion 32 at its bottom pushes the hooks 22 at the lower edge of the embedding ring 20, so that the hooks 22 of the embedding ring 20 are pressed and deformed into an outwardly inverted hooks, and the distal ends of the hooks 22 precisely abut the lower edge of the floor 90 to clamp the floor 90 between the blocking ring edge 21 of the embedding ring 20 and the hooks 22. In the meantime, the hook portions of the hooks 22 of the embedding ring 20 are latched into the ring embedding grooves 34 disposed on the external circumference of the water drain body 30, so as to form a tight latch relation to prevent the water drain body 30 from moving upward or separating the embedding ring 20, and further form a positioning relation between the embedding ring 20 and the water drain body 30 to secure the water drain body 30 to the floor 90. The seal washer 40 is pressed by the embedding ring 20 and the water drain body 30 to achieve the seal anti-leakage state among the floor 90, the embedding ring 20 and the water drain body 30, and then the seal ring 50 and the pressing member 60 are installed into the internal hole of the water drain body 30, such that the seal ring 50 is blocked by an opening portion at the top of the drainage pipe 100, and the lower edge of the blocking ring 51 of the seal ring 50 is in contact with the rim of the top of the drainage pipe 100, and finally the jam-on member 70 is installed and pressed into the internal hole of the water drain body 30, and the pipe pressing portion 72 of the jam-on member 70 presses the pressing member 60 down so that the pressing member 60 compresses the seal ring 50. During the process of pressing the pressing member 60 down, the design of the guiding net 61 extended from its lower edge allows the drainage pipe 100 to be guided and corrected properly to assure the concentric status with the water drain body 30, and the seal ring 50 is pressed and deformed to abut an external wall of the drainage pipe 100 and the top of its opening and an internal wall of the water drain body 30 in order to achieve a good seal anti-leakage effect. Finally, the jam-on member 70 is removed, and a strainer 80 having the drain holes 81 is embedded to the top of the water drain body 30 to complete the overall installation of the water drain with the floor 90.

In view of the description above, only two simple and easy pressing actions are required in the entire process of installing the water drain with the floor, such that the assembling and the seal anti-leakage relation between the water drain body 30 and the floor 90, and between the water drain body 30 and the drainage pipe 100 can be achieved without requiring a hand tool for the installation. The invention makes the entire assembling process, simple, easy and quick. In the meantime, the assembling does not involve any screws, and thus the structural design of the water drain body 30 and its related accessories become simpler, or even a general copper pipe available in the market can be used for making the water drain body 30 of the invention. As a result, the overall manufacturing cost can be lower. Since the water drain body 30 and the floor 90 are combined by deforming and latching the hooks 22 of the embedding ring 20 instead of using traditional screws, and the hooks 22 will not cause any interference to the installation of the embedding ring 20 into the drain through hole of the floor 90. Regardless of a first-time installation or a replacement of the water drain, the construction can be completed without damaging the floor of a bathroom. Particularly for the replacement of the water drain, the water drain body 30 can be removed from the floor simply by a flat-blade screwdriver without damaging the floor structure, and a new water drain can be installed by a simple pressing action. Compared with the difficulty of replacing a water drain having a screw locking from opposite side of shower base or the trouble of damaging the floor of a bathroom as in the prior art, the structural design of the present invention can meet the requirements of industrial applications.

In the foregoing embodiment, the water drain is applied to a floor of a maintenance-ready type sanitary equipment, but it is noteworthy to point out that the invention is not limited to such arrangement only. The basic structure of the water drain in accordance with the present invention can also be applied to a washing basin, a bathtub, a kitchen sink or a laundry sink to achieve the similar simple, easy and quick installation.

In summation of the description above, the structural design of the water drain assembly of the present invention provides a simple, easy and quick installation for the water drain and the drain through hole and the drainage pipe by a simple and easy pressing action to achieve a seal anti-leakage effect, so as to simplify the overall structure and lower the manufacturing cost effectively. In the meantime, the invention maintains the convenience for repair and maintenance, and thus the present invention herein enhances the performance over the conventional structure, and definitely can overcome the shortcomings of the prior art and comply with the requirements of patent application, and is thus duly filed for patent application.

What is claimed is:

1. A water drain assembly, comprising:

an embedding ring, made of a low-priced plastic, an external diameter thereof matching a hole diameter of a drain through hole, and a top thereof being slightly larger than a blocking ring edge, such that the drain through hole limits its position when the embedding ring is installed into the drain through hole, the embedding ring having a predetermined quantity of hooks extending inwardly from a bottom thereof and having a gap between two adjacent ones of the hooks, and an external circumference of the embedding ring being tapered from a top of the gap, such that a structure at the hooks is thinner and weaker to provide a better deformation rate;

a water drain body, with an external diameter thereof matching an internal diameter of the embedding ring, and a top thereof being large enough to cover a ring plate at the blocking ring edge of the embedding ring, having a circular slanting push portion disposed slantingly inward at a bottom of the water drain body, such that a through hole formed by the circular slanting push portion is slightly larger than an external diameter of a corresponding drainage pipe;

a seal washer, made of a rubber material, and having a ring embedding edge disposed around an internal circumference of the seal washer, such that the embedding ring is sheathed into the seal washer, and the blocking ring edge at the top of the embedding ring is stopped and limited at a top of the ring embedding edge, so that the seal washer serves as a water stop interface among the embedding ring, the water drain body and the drain through hole to achieve an seal anti-leakage effect;

a seal ring, made of a rubber material, and having an external diameter matching an internal diameter of the water drain body, and a blocking ring disposed around an internal circumference of the seal ring, such that a cross-section of the blocking ring is equal to that of the corresponding drainage pipe, and a top of the corresponding drainage pipe is assembled easily during its installation;

a pressing member, with an external circumference thereof tightly coupled with an internal circumference of the water drain body, and having a guiding net extended from a lower edge of the pressing member, the guiding net being formed by intersecting a plurality of strip plates extending from the pressing member, having a straight and flat section, and a lower section in a curved shape, the depth of the straight and flat section of the guiding net being greater than a thickness of the seal ring, and an external diameter of the straight and flat section of the guiding net being slightly smaller than an internal diameter of the corresponding drainage pipe, so that the guiding net concurrently has the functions of guiding the corresponding drainage pipe into a proper position and filtering hairs;

a jam-on member, with a top having a dimension slightly larger than a stop ring at an internal hole of the water drain body, for preventing the jam-on member from being sheathed completely into the internal hole of the water drain body, having a pipe pressing portion with an external diameter thereof being slightly smaller than the internal diameter of the water drain body, and a length D of the pipe pressing portion is at least greater than a depth A of the internal hole of the water drain body minus a thickness B of the seal ring and plus a thickness C of the pressing member ($D>A-B+C$); and a strainer, embedded onto the top of the water drain body and having a plurality of drain holes disposed thereon.

2. The water drain assembly of claim 1, wherein the water drain body includes a ring embedding groove with an aslant top and a flat bottom being disposed at a predetermined position of an external circumference of the ring embedding groove, so that when the water drain body and the embedding ring are installed, a hook portion of a deformed embedding ring hook is latched into the ring embedding groove to enhance its positioning effect.

* * * * *